US009744434B2

(12) United States Patent
Gulyassy

(10) Patent No.: US 9,744,434 B2
(45) Date of Patent: Aug. 29, 2017

(54) CUE WITH SOLID CORE CONSTRUCTION

(71) Applicant: Baby's Pro Shop, LLC, Greenville, SC (US)

(72) Inventor: Mike Gulyassy, Greenville, SC (US)

(73) Assignee: Baby's Pro Shop, LLC, Greenville, SC (US)

( * ) Notice: Subject to any disclaimer, the term of this patent is extended or adjusted under 35 U.S.C. 154(b) by 0 days.

(21) Appl. No.: 14/803,905

(22) Filed: Jul. 20, 2015

(65) Prior Publication Data

US 2016/0184693 A1 Jun. 30, 2016

Related U.S. Application Data

(60) Provisional application No. 62/029,192, filed on Jul. 25, 2014.

(51) Int. Cl.
*A63D 15/08* (2006.01)
*A63D 15/12* (2006.01)

(52) U.S. Cl.
CPC ..... *A63D 15/08* (2013.01); *A63D 15/12* (2013.01)

(58) Field of Classification Search
CPC ..... A63D 15/08; A63D 15/12
USPC ..... 473/44, 49
See application file for complete search history.

(56) References Cited

U.S. PATENT DOCUMENTS

| | | | | |
|---|---|---|---|---|
| 125,643 A | | 4/1872 | Wilbur | |
| 192,044 A | | 6/1877 | Hill | |
| 278,934 A | | 6/1883 | Gleason | |
| 983,938 A | | 2/1911 | Scheurmann | |
| 1,007,668 A | | 11/1911 | Barrows | |
| 1,241,194 A | * | 9/1917 | Carlson | A63D 15/08 473/44 |
| 1,505,609 A | * | 8/1924 | Seeman et al. | A63D 15/08 473/44 |
| 1,512,554 A | | 10/1924 | Magono | |
| 1,560,456 A | | 11/1925 | Wolpert | |
| 1,702,292 A | | 2/1929 | Barrett | |
| 2,544,970 A | | 3/1951 | Watson | |
| 3,368,271 A | * | 2/1968 | Scheffler | A63D 15/08 273/DIG. 7 |
| 5,016,877 A | | 5/1991 | Lowery | |

(Continued)

FOREIGN PATENT DOCUMENTS

| | | |
|---|---|---|
| GB | 2226251 | 6/1990 |
| GB | 2254794 | 10/1992 |

*Primary Examiner* — Mark Graham
(74) *Attorney, Agent, or Firm* — Thorpe North & Western, LLP

(57) ABSTRACT

A pool cue includes a butt having: an elongate central butt core, extending uninterrupted from a rearmost end of the butt to a foremost end of the butt; one or more oversleeves arranged about the central butt core and abutting one another; and a forward threaded butt connector positioned on the foremost end of the butt, the forward threaded butt connector operable to mate with a corresponding threaded shaft connector of a cue shaft. A shaft has: an elongate shaft sleeve, extending from a rearmost end of the shaft to a foremost end of the shaft; an elongate central shaft core, extending uninterrupted from the rearmost end of the shaft to the foremost end of the shaft; and a rearward threaded shaft connector positioned on the rearmost end of the shaft, the rearward threaded shaft connector operable to mate with the threaded butt connector.

4 Claims, 4 Drawing Sheets

(56) References Cited

U.S. PATENT DOCUMENTS

| | | | | |
|---|---|---|---|---|
| 5,112,046 | A | 5/1992 | Thorpe | |
| 5,326,329 | A | 7/1994 | Doss | |
| 5,527,224 | A * | 6/1996 | Costain | F16B 7/182 473/44 |
| 5,725,437 | A | 3/1998 | McCarty et al. | |
| 5,820,473 | A | 10/1998 | Lambros | |
| 5,938,536 | A | 8/1999 | Minke | |
| 6,251,024 | B1 | 6/2001 | Summers et al. | |
| 7,097,570 | B2 | 8/2006 | Gulyassy | |
| 7,452,282 | B2 | 11/2008 | Gulyassy | |
| 8,075,414 | B2 | 12/2011 | Owen et al. | |
| 8,075,415 | B2 | 12/2011 | Owen et al. | |
| 2002/0082098 | A1 * | 6/2002 | Lai Chuang | A63D 15/08 473/44 |
| 2003/0153393 | A1 * | 8/2003 | Chang | A63D 15/08 473/44 |
| 2007/0066411 | A1 * | 3/2007 | Gulyassy | A63D 15/12 473/44 |
| 2008/0064515 | A1 * | 3/2008 | Titus | A63D 15/08 473/44 |
| 2008/0132345 | A1 * | 6/2008 | Dimick | A63D 15/083 473/44 |
| 2008/0153612 | A1 * | 6/2008 | Bowe | A63D 15/08 473/44 |
| 2009/0111596 | A1 * | 4/2009 | Owen | A63D 15/08 473/47 |
| 2009/0253525 | A1 * | 10/2009 | Lickfold | A63D 15/12 473/49 |
| 2014/0148259 | A1 * | 5/2014 | Oeffner | A63D 15/12 473/49 |

* cited by examiner

CUE WITH SOLID CORE CONSTRUCTION

PRIORITY CLAIM

Benefit is claimed of and to U.S. Provisional Patent Application Ser. No. 62/029,192, filed, Jul. 25, 2014, which is hereby incorporated herein by reference in its entirety.

BACKGROUND OF THE INVENTION

Field of the Invention

The present invention relates generally to the field of cues used in cue sports such as billiards, snooker, pocket billiards and the like. More particularly, the present invention relates to two-piece cues that can be disassembled for ease of transport and storage.

Related Art

Cues used in playing the game of pool (billiards and pocket billiards) are often provide in a two-piece construction to allow the cue to be more easily transported. The base section, which the user grasps in his or her grip (rearmost) hand, is referred to as the "butt" section. The forward section, which the user grasps with his or her bridge (foremost) hand, is referred to as the "shaft." These two sections are very often mated via a threaded connection that allows the shaft and butt to be relatively easily attached one to another.

The shaft of a cue is typically formed with performance in mind: the shaft must not warp, and the degree of flexure provided by the shaft is a critical component of the way in which the cue performs. The surface finish of the shaft is very important, as it must slide easily in the player's bridge hand. The butt section is typically crafted with aesthetics in mind: butts often have exotics woods, inlays and wraps applied to them to provide a desired look to the cue. Also, many players prefer a very specific wrap on the butt section, formed of materials such as Irish Linen, leather, etc.

The butt section and the shaft section, and the jointery between the two, all play a role in transferring force from the user to the cue ball. Impacting the cue ball with a tip of the pool cue results in force being transferred along the entire length of the pool cue. It is primarily the transfer of this force, and the feel produced by striking the cue ball, that distinguishes one cue from another, in terms of performance.

While it is relatively easy to provide two pieces that can mate one with another to form a cue, it is not an easy matter to provide a mating arrangement that provides a desired feel when a cue ball is struck with the cue. As many differing components are coupled one to another to form the totality of the cue, many cues do not provide a solid hit when a cue ball is stroked with the cue.

SUMMARY OF THE INVENTION

In accordance with one aspect of the invention, a butt for use in a pool cue is provided, including an elongate central butt core, extending uninterrupted from a rearmost end of the butt to a foremost end of the butt. One or more oversleeves can be arranged about the central butt core and abutting one another. A forward threaded butt connector can be positioned on the foremost end of the butt, the forward threaded butt connector operable to mate with a corresponding threaded shaft connector of a cue shaft.

In accordance with another aspect of the invention, a shaft for use in a pool cue is provide, including an elongate shaft sleeve, extending from a rearmost end of the shaft to a foremost end of the shaft. An elongate central shaft core can extend uninterrupted from the rearmost end of the shaft to a foremost end of the shaft. A rearward threaded shaft connector can be positioned on the rearmost end of the shaft, the rearward threaded shaft connector operable to mate with a corresponding threaded shaft connector of a cue butt.

In accordance with another aspect of the invention, a pool cue is provided, including a butt section that includes an elongate central butt core, extending uninterrupted from a rearmost end of the butt to a foremost end of the butt. One or more oversleeves can be arranged about the central butt core and abutted adjacent one another. A forward threaded butt connector can be positioned on the foremost end of the butt, the forward threaded butt connector operable to mate with a corresponding threaded shaft connector of a cue shaft. A shaft section can also be included, including an elongate shaft sleeve, extending from a rearmost end of the shaft to a foremost end of the shaft. An elongate central shaft core can extend uninterrupted from the rearmost end of the shaft to the foremost end of the shaft. A rearward threaded shaft connector can be positioned on the rearmost end of the shaft, the rearward threaded shaft connector operable to mate with the threaded butt connector.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

Figure 1:
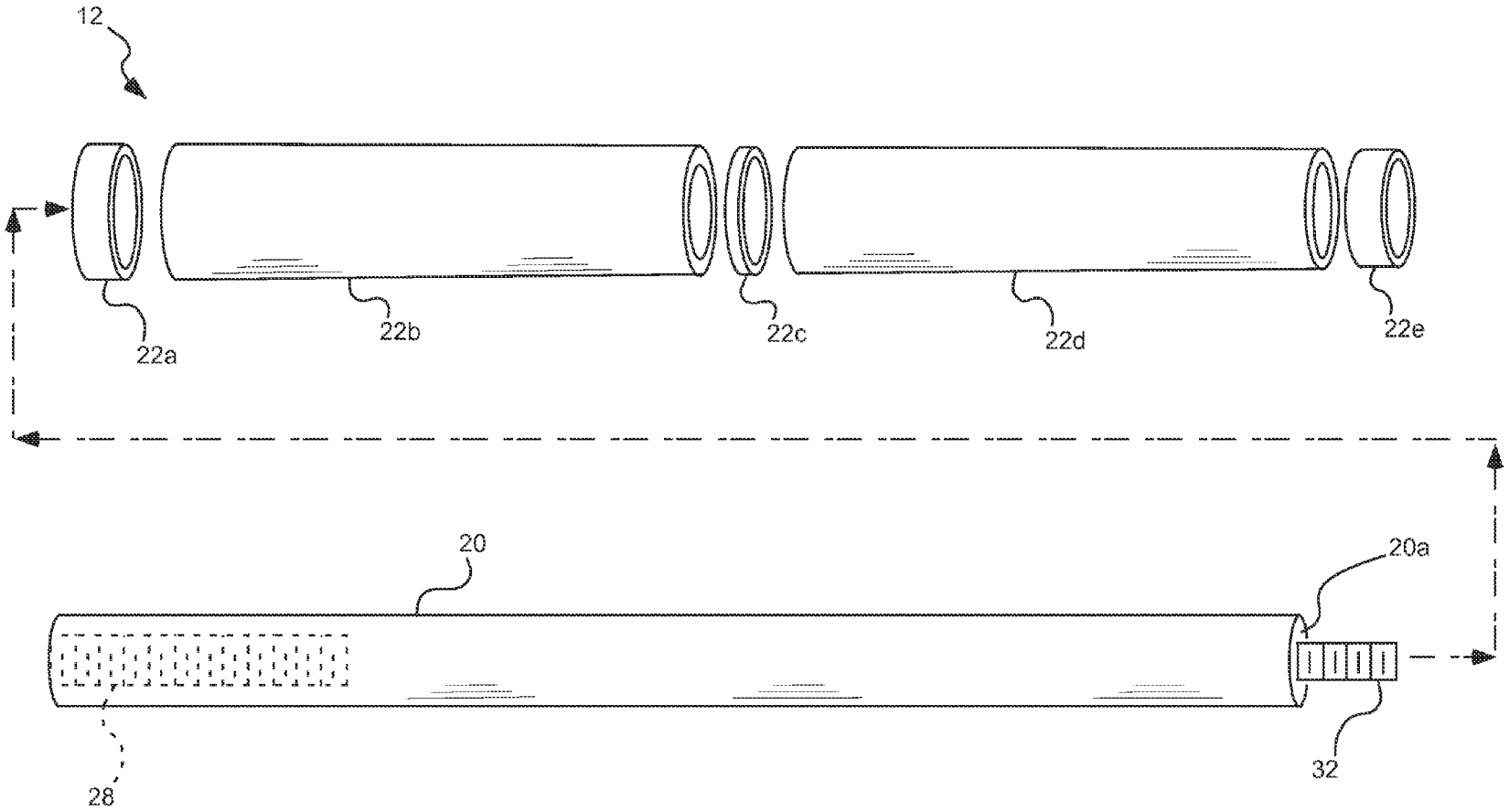
FIG. 1 is an exploded side view of various components of a pool cue butt in accordance with an embodiment of the invention.

It is noted that the components shown in the figures are not drawn to scale, and may not be proportionally shown relative to an actual device. For example, in the interest of clarity, the sections illustrated are generally shown as much shorter than an actual device, in order to fit each drawing on a page and illustrate the relevant details. A physical cue made in accordance with the present technology would have a length-to-thickness ratio on the order of 25:1. In the drawings, however, the length-to-thickness ratio is on the order of 13:1 (the views present the cue as more "stubby" than it actually is). This is done to more clearly illustrate the relevant features of the invention, and should not in any way limit or otherwise affect the present claims.

DETAILED DESCRIPTION

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting.

It must be noted that, as used in this specification and the appended claims, the singular forms "a" and "the" can include plural referents, unless the context clearly dictates otherwise. Thus, for example, reference to an "oversleeve" can include reference to one or more of such oversleeves.

Definitions

In describing and claiming the present invention, the following terminology will be used in accordance with the definitions set forth below.

Relative directional terms, such as "forward," "rearward," "upper," "lower," "top," "bottom," etc., may be used herein to aid in describing various features of the present systems and techniques. It is to be understood that such terms are generally used in a manner consistent with the understanding one of ordinary skill in the art would have of such systems. Such terms should not, however, be construed to limit the present invention.

As used herein, the term "substantially" refers to the complete, or nearly complete, extent or degree of an action, characteristic, property, state, structure, item, or result. As an arbitrary example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As another arbitrary example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

Distances, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 inch to about 5 inches" should be interpreted to include not only the explicitly recited values of about 1 inch to about 5 inches, but also include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value and should apply regardless of the breadth of the range or the characteristics being described.

Invention

Figure 2:
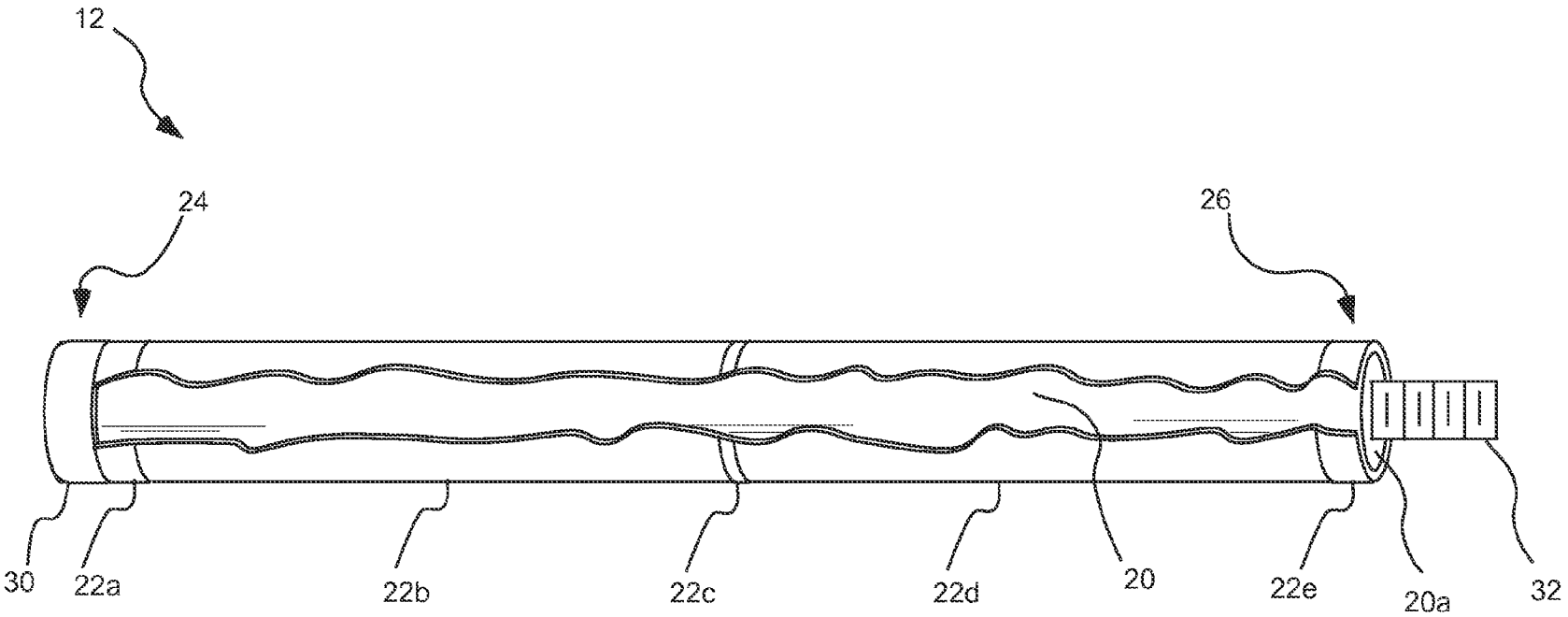
FIG. 2 is a partially sectioned side view of the components of FIG. 1, assembled into a full butt section.
Figure 3A:
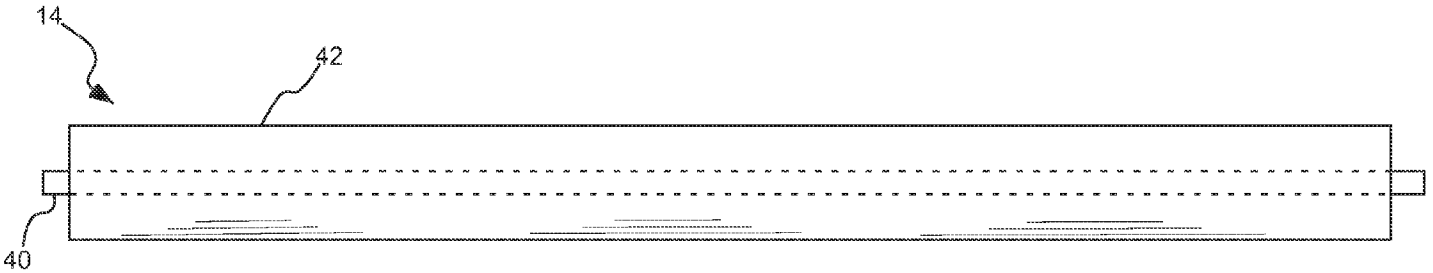
FIG. 3A is a side view of a shaft section of a pool cue, prior to finishing the shaft section.
Figure 3B:
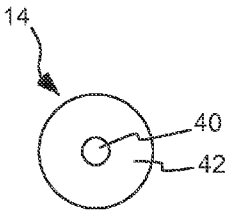
FIG. 3B is an end view of the shaft section of FIG. 3A.
Figure 3C:
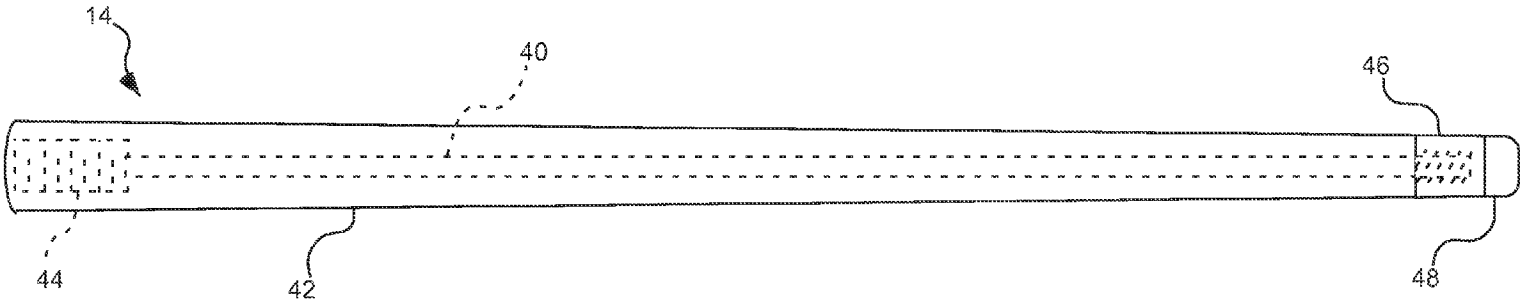
FIG. 3C is a side view of the shaft section of FIG. 3A, after being finished.
Figure 4:
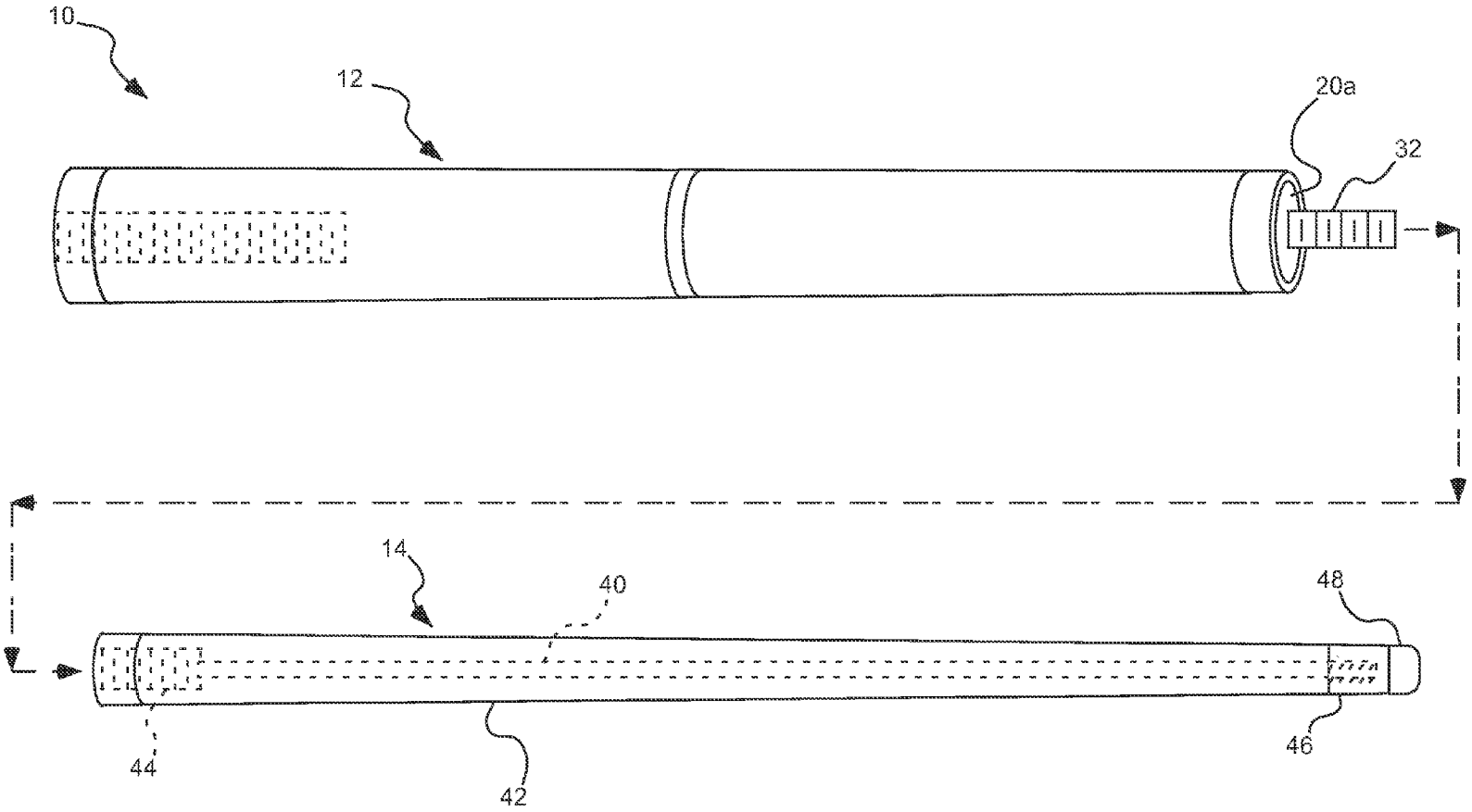
FIG. 4 is a side, partially exploded view of a pool cue formed from the butt section of FIG. 2 and the shaft section of FIG. 3C.

The present invention relates generally to constructions for use in pool cues. Cues formed according to the present technology provide a superior feel when striking a cue ball, and more efficiently transfer the force from a player's gripping hand to the cue ball. The cues provided by the present technology include two primary components: a cue butt and a cue shaft. FIGS. 1 and 2 generally illustrate the butt section 12, while FIGS. 3A, 3B and 3C illustrate the shaft section 14. FIG. 4 illustrates the entire cue 10, with butt section 12 and shaft section 14 coupleable to one another.

Turning now specifically to FIGS. 1 and 2, in one aspect of the invention, a butt section or segment 12 is provided. The butt section can include an elongate central butt core 20. The butt core 20 can extend as an uninterrupted unit from a rearmost end (24 in FIG. 2) of the butt to a foremost end (26 in FIG. 2) of the butt. One or more oversleeves 22 can be arranged about the central butt core, and can abut one another in the final configuration (see FIG. 2, for example). The number and type of oversleeves can vary widely, depending upon the grip interface desired and the aesthetic desired. In the example shown, oversleeves 22*a*, 22*b*, 22*c*, 22*d* and 22*e* are shown. These, however, are but examples of the number and type of oversleeves that can be provided.

In one example, segment 22*e* can be a phenolic joint sleeve, about ½ inch in length. Segment 22*d* can be a maple (or other wood) forearm piece, about 12.5 inches in length. One or more phenolic rings 22*c* can be dispersed along the length of the butt. A handle sleeve 22*b* can be about 12 inches in length. A butt sleeve (not shown) can be about 3 inches in length. A butt cap 22*a* can be about ½ in length. The total length of the butt can vary depending upon the overall length of the cue desired: typical lengths are 28 inches, 29 inches, 30 inches, etc.

Generally speaking, the oversleeves 22 will collectively cover the entirety of the elongate central core 22. Each of the oversleeves shown can include an inner diameter that corresponds to an outer diameter of the central core 20. Each inner diameter may vary slightly, if the central bore includes a taper. Typically, however, the outer surface of the oversleeves will collectively taper from the rearmost end 24 to the forwardmost end 26 of the butt. In one example the outer diameter of the central core is about ¾ inch: hence, each of the oversleeves will have a bore of this same diameter so that they fit snugly about the central core. The oversleeves can be attached to the central core in a variety of manners, as would be appreciated by one of ordinary skill in the art having possession of this disclosure. In one embodiment of the invention, the oversleeves can be bonded about the elongate central core. Once assembled, the oversleeves are typically never removed from the inner butt core: hence, the interface between the two is generally permanent.

The elongate central butt core 20 can be formed from a variety of materials and in a variety of configurations. In one embodiment, the core is formed from a polymer. One suitable such polymer is C-grade phenolic polymer, or other types of laminate phenolic, such as linen phenolic, paper phenolic, wool phenolic, cotton, woven glass, etc. In other embodiments, it can be formed from wood, metal, other composite materials, and the like. The core can include a diameter of about 0.500 inches to about 0.75 inches, or from about 0.625 inches to about 0.75 inches. The diameter can be increased or decreased (within or outside of these ranges), depending upon the weight desired, the type of materials used for the oversleeves, various stiffness considerations, etc. In most cases, changes to the diameter of the butt core will result in a corresponding modification of the inner diameter of oversleeves 22 (e.g., a thicker inner butt core will result in thinner oversleeves).

The central butt core 20 can include internal threads 28 that can receive one or more weight bolts (not shown) to aid in balancing the weight of the overall cue, or in increasing or decreasing the weight of the overall cue. The internal threads 28 can also accept an end cap, or bumper (30 in FIG. 2) that serves to protect the end (or bottommost surface, when held upright) of the cue from damage when striking a floor or other surface. The end cap or bumper is generally a soft rubber piece that can include male threads to fit within the internal threads 28. It can also be held within the bottom of the butt with a friction fit, or with a bonding agent.

The foremost end 26 of the butt 12 can include a forward threaded butt connector (known as the "pin") 32 that allows the butt to be mated with the shaft 14 (described in more detail below). In the example shown, the pin includes a male thread that mates with a corresponding female thread in a shaft segment (e.g., in insert 44 in FIG. 3C). The pin can be intimately mated with internal threads formed in the solid butt core, with no intervening material. In other words, the pin can be threadably received directly within the material of the butt core. In this manner, an intimate coupling can be made with the shaft connected to the butt at this location. The shaft will mate tightly against the end surface 20*a* of the central core to achieve the highest degree of contact to provide the most efficient and effective energy transfer from the butt, to the shaft and into the cue ball.

While not so required, in one embodiment, the threaded pin 32 is formed from the same material as is the elongate central butt core 20. As discussed in more detail below, these two components can also be formed from the same material as is the elongate central shaft core 40. The threaded pin and central butt core can be formed from a polymeric material, if so desired, or a wood material, metal, etc. In one embodiment, they are formed from phenolic, which can be a C-grade phenolic. Several advantages are gained by forming these components from the same material: the transfer of forced from one material to the other is optimized in this way; thermal expansion is more closely matched between the components, etc.

The butt core 20 can be formed from an integral, continuous piece of material. In one aspect, this continuous piece of material includes no discontinuities in material, no joints or splices, etc. In this manner, the transfer of force, and the reduction of losses due to vibration, etc., are minimized.

Turning now to FIGS. 3A, 3B and 3C, a further aspect of the invention is illustrated in which a shaft 14 is provided. FIGS. 3A and 3B illustrates an initial phase of shaft preparation in which an elongate central shaft core 40 is fitted within a shaft sleeve 42. The shaft core can be installed within the shaft sleeve in a number of manners. In one example, the shaft core is about 0.275 inches in diameter. The shaft sleeve can be bored, along the entire length of the sleeve, to a diameter about 0.010 inches greater than this. The shaft core can then be inserted into the bored shaft sleeve, and bonded in place with a suitable adhesive.

After the assembly shown in FIGS. 3A and 3B is allowed to cure, the shaft can be finished. This process can include machining material away from the shaft sleeve 42 to provide the taper, and to create a very smooth finish. Materials, coatings, etc., can be applied to the finished shaft surface to improve smoothness and durability, etc. The type of material used in the shaft sleeve 42 can dictate the specifics of this process. This material can vary, but include materials conventionally used in shafts, including wood, wood laminates, composite materials and the like.

At the rearward (leftmost, in FIG. 3C) end of the shaft, an insert 44 can be installed within the shaft sleeve 42 (after a suitable opening has been formed therein). The insert can include a threadable interface to mate with a threadable interface from a cue butt (for example, pin 32 of FIG. 2). In the example shown, the insert 44 includes female threads, it being understood that, if desired, the butt could instead include female threads and the shaft could include male threads. Typically, the insert will be glued within the shaft sleeve as a solid block of material. After the adhesive is cured, the insert will be drilled and tapped to provide the threaded interface. In one example, the insert is about 0.5 inches in diameter, and about 2 inches in length.

As with other components discussed herein, the insert 44 can be formed from the same material as is the shaft core 40. The insert and the rearmost (leftmost, in FIG. 3C) end of the shaft core can be abutted very tightly one against the other, and bonded one to another, to ensure the shaft core is tightly seated against the insert. In some embodiments, the adhesive used to accomplish this actually welds the two components one to another (particularly when they are formed from a polymer), ensuring a very secure interface.

At the forwardmost (rightmost, in FIG. 3C) end of the shaft core 40, the shaft core can be threaded to threadably receive a ferrule 46. A tip 48 can be bonded to the ferrule, using materials and techniques known to those of ordinary skill in the art. The threaded interface between the shaft core and the ferrule once again ensure a very tight interface between the components of the shaft. As with the butt core 20, the shaft core 40 can be formed from an integral, continuous piece of material. In one aspect, this continuous piece of material includes no discontinuities in material, no joints or splices, etc. In this manner, the transfer of force, and the reduction of losses due to vibration, etc., are minimized.

FIG. 4 illustrates a complete cue 10 in accordance with the present invention. The butt 12 in this case includes pin 32 that fits within threaded insert 44 of the shaft 14. Once these two interfaces are tightened one against the other, the present cue is ready for use. The present inventor has found that the "hit" provided by the present cue is far superior to conventional constructions. Due to the continuity of materials, and carefully designed joint interfaces, the transfer of force to and through the user's hands when the tip 48 strikes a cue ball is as smooth as possible with a two-piece cue construction.

When the relevant components are formed from the same material, such as a polymeric material like phenolic, the same material can extend from the tip 48 of the cue to and through the butt end of the cue. As discussed above, the ferrule 46, the shaft core 40, the threaded insert 44, the butt core 20 (including the end surface 20*a* of the butt core) and the pin 32 can all be formed from the same material. When this material is a polymer, the bond or weld achieved between components can be optimized, to provide the superior feel experienced by users of the present cue. As discussed above, this polymer can be a C-grade (canvas) phenolic polymer, or other types of laminate phenolic, such as linen phenolic, paper phenolic, wool phenolic, cotton, woven glass, etc.

In addition to the structural features discussed above, the present invention can also provide methods of forming pool cues, including cue segments such as butts and shafts. Such methods would be readily apparent to one of ordinary skill in the art having possession of this disclosure.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

I claim:

1. A pool cue, comprising:

a butt, including:

an elongate central butt core formed of phenolic and having threads formed in a forward end thereof, the elongate central butt core extending uninterrupted from a rearmost end of the butt to a foremost end of the butt;

a plurality of oversleeves arranged about the central butt core and abutted adjacent one another;

a forward threaded butt connector inserted within the threads formed in the elongate central butt core, the forward threaded butt connector operable to mate with a corresponding threaded shaft connector of a cue shaft; and a shaft, including:

an elongate shaft sleeve, extending from a rearmost end of the shaft to a foremost end of the shaft;

an elongate central shaft core, formed of phenolic and extending uninterrupted from the rearmost end of the shaft to the foremost end of the shaft;

a rearward threaded shaft connector positioned on the rearmost end of the shaft, the rearward threaded shaft connector including a threaded shaft insert installed within the elongate shaft sleeve at the rearmost end of the elongate shaft sleeve, the elongate central shaft core being thereby intimately coupled to the threaded shaft insert within the shaft sleeve, the threaded shaft insert being operable to mate with the threaded butt connector; and a ferrule, extending over or into the elongate central shaft core at the foremost end of the shaft, the ferrule being formed of phenolic and being operable to receive a playing tip;

the elongate central shaft core and the elongate central butt core each being an integral, continuous piece of material.

2. The cue of claim 1, further comprising a series of ferrule threads formed on or in the forward end of the elongate central shaft core and wherein the ferrule is threadably engaged with the elongate central shaft core.

3. The cue of claim 1, wherein the forward threaded butt connector includes a threaded pin fitted directly within the internal threads formed in the foreward end of the elongate central butt core.

4. The cue of claim 3, wherein the threaded pin is formed from phenolic.

* * * * *